US007835499B2

(12) United States Patent
Yu et al.

(10) Patent No.: US 7,835,499 B2
(45) Date of Patent: Nov. 16, 2010

(54) COMPACT, SHORT-PULSE X-RAY AND T-RAY FUSED SOURCE

(75) Inventors: David U. L. Yu, Rancho Palos Vrds, CA (US); Alexei V. Smirnov, c/o DULY Research Inc, 1912 MacArthur St., Rancho Palos Vrd, CA (US) 90275

(73) Assignees: David U. Yu, Rancho Palos Verdes, CA (US); Alexei V. Smirnov, Rancho Palos Verdes, CA (US)

( * ) Notice: Subject to any disclaimer, the term of this patent is extended or adjusted under 35 U.S.C. 154(b) by 91 days.

(21) Appl. No.: 12/384,441

(22) Filed: Apr. 3, 2009

(65) Prior Publication Data

US 2010/0072405 A1 Mar. 25, 2010

Related U.S. Application Data

(63) Continuation-in-part of application No. 11/999,754, filed on Dec. 7, 2007, now Pat. No. 7,649,328.

(51) Int. Cl.
*H05G 2/00* (2006.01)

(52) U.S. Cl. ..... 378/119

(58) Field of Classification Search ..... 378/119; 250/493.1, 504 R; 372/5; 315/505
See application file for complete search history.

(56) References Cited

U.S. PATENT DOCUMENTS

| | | | | |
|---|---|---|---|---|
| 6,333,966 | B1 * | 12/2001 | Schoen | 378/119 |
| 6,724,782 | B2 * | 4/2004 | Hartemann et al. | 372/5 |
| 7,379,530 | B2 * | 5/2008 | Hoff et al. | 378/57 |
| 7,391,850 | B2 * | 6/2008 | Kaertner et al. | 378/118 |

* cited by examiner

*Primary Examiner*—Courtney Thomas

(57) ABSTRACT

A pulse source generates both terahertz radiation (T-rays) and X-rays consecutively at high peak intensity using the same electron beam generated in an RF photoinjector and two different extractors/radiators for the T- and X-rays.

5 Claims, 5 Drawing Sheets

13
14
10
24
22
7
3
13
17
21
5
27
18
12
4
2
16
24
20
19
15
8
6
1

COMPACT, SHORT-PULSE X-RAY AND T-RAY FUSED SOURCE

RELATED APPLICATION

This application is a continuation-in-part of application Ser. No. 11/999,754 filed Dec. 7, 2007 now U.S. Pat. No. 7,649,328.

BACKGROUND OF THE INVENTION

1. Field of the Invention

The present invention relates to a synchronized X-ray or gamma-ray and high peak power, coherent terahertz source, and more particularly to a picoseconds laser-electron system for X-ray and T-ray screening and imaging of personnel, baggage and cargo containers.

2. Description of the Prior Art

X-rays and T-rays represent two kinds of radiation with wavelengths that are extremely short (less than a fraction of angstrom for X-rays and gamma-rays) and very long (fraction of millimeters for terahertz).

X-ray sources have been known for more than a hundred years and are widely used in medicine for imaging, diagnostics and therapy; in physics, biology and chemistry, and in other sciences and technologies including the semiconductor industry. A wide range of different X-ray and Gamma-ray devices and facilities are currently in operation: radiographic sources using radioactive isotypes (such as Co-60), classical vacuum High-Voltage (HV) tubes, various linear and circular accelerators that use Bremstrahlung radiation from a high-mass target like tungsten, synchrotron electron storage rings that produce high-brightness X-ray radiation from bending magnets and wigglers, backscattering Compton sources that produce high-brilliance X- and gamma-radiations by colliding energetic electron beams with coherent, intense flux of photons generated by lasers (including Free Electron Lasers or FELs), and super radiant FELs that use Self-Amplified Spontaneous Emission (SASE) of multi-GeV electron beam self-bunched in a very long undulator (e.g., about 100 m undulator in the LCLS FEL at SLAC). In the last three decades there have been advanced research, studies and applications using short-pulse, high-peak-brightness X-ray radiation produced in storage rings and synchrotrons.

X-ray sources have been known for more than a hundred years and are widely used in medicine for imaging, diagnostics and therapy, in physics, biology and chemistry, and in other sciences and technologies including the semiconductor industry. A wide range of different X- and Gamma-ray devices and facilities are operating: radiographic sources using radioactive isotopes (such as Co-60), classical vacuum High-Voltage (HV) tubes, various linear and circular accelerators that use Bremstrahlung radiation from a high-mass target like tungsten, synchrotron electron storage rings that produce high-brightness X-ray radiation from bending magnets and wigglers, backscattering Compton sources that produce high-brilliance X- and Gamma-radiations by colliding energetic electron beams with coherent, intense flux of photons generated by lasers (including Free Electron Lasers or FELS), and superradiant FELs that use Self-Amplified Spontaneous Emission (SASE) of multi-GeV electron beam self-bunched in a very long undulator (e.g., about 100 m undulator in the LCLS FEL at SLAC). In the last three decades there have been advanced research, studies and applications using short-pulse, high-peak-brightness X-ray radiation produced in storage rings and synchrotrons. Recent developments in this field suggest much more compact, bright and ultra-short pulse X-ray sources based on a laser accelerator and heavy target (U.S. Pat. No. 6,333,966 to Schoen), relativistic electron injector and laser beam (i.e. inversed Compton source, U.S. Pat. No. 6,724,782 to Hartemann et al and U.S. Pat. No. 7,391,850 to Kaertner et al). U.S. Pat. No. 7,379,530 to Hoff et al applies a pair of pulse gamma-sources for detection of nuclear devices within a container but does not disclose how the short gamma-ray pulses are produced.

The history of THz sources is more recent. In particular, compact or small terahertz sources available today operate mostly in the CW mode and deliver very low maximum power not exceeding several watts. Such devices include Gunn diodes, Schottky varactor, IMPATT, TUNNET solid-state diode arrays, solid-state laser on lightly doped p-type germanium mono-crystals, Quantum Cascade Lasers, vacuum electronics devices: orotrons, clinotrons, Smith-Purcell, BWO, TWT, and molecular line-tunable lasers, e.g., $CO_2$-pumped methanol.

Time-domain THz spectroscopy uses two types of pulse terahertz compact sources: electro-optical and photoconductive antennas that provide laser frequency downconversion or optical rectification. These incoherent, broadband sources are pumped with a femtosecond laser and cannot deliver more than a dozen of kW peak power even if an array of thousands of such emitters is used. Short-pulse THz sources based on relativistic electron beams can deliver much higher pulse energies at high maximum power—typically tens of kilowatts from FELs, gyrotrons, synchrotrons and storage rings. However these sources are large and very expensive. Only a few of them can deliver peak power exceeding 100 kW.

Peak power of hundreds of kW in ps-sub-ns range from more compact (than FEL) sources is crucial for the investigation of a large variety of non-linear phenomena and fast processes at THz frequencies. Compactness, easy access, and minimal thermal load that should remain well below 100 mW are also critical for these applications.

Many small laboratories and research groups in government and private sectors conduct research using both X-ray and terahertz radiations and develop corresponding techniques using ultrashort pulses. Currently both of these radiations of high peak intensities are available only at large national facilities with energetic electron beams: coherent synchrotron radiation sources and some linear accelerators equipped with corresponding insertion devices (undulators, bending magnets and wigglers) such as the Advanced Photon Source (APS) at LBNL or the JLAB FEL. These machines are very expensive (>$10 mln for low energy machines with moderate parameters) and are currently confined to government laboratories for basic research applications Applications of both X- and T-rays include, but are not limited to, protein crystallography; identification and selective modification (e.g., mild-ablation) of DNA, enzymes, proteins and capsides (protective protein shells) of viruses.

Another example of a fused X-T ray application is homeland security: X-ray screening to be added with T-ray screening to enable remote detection of concealed weapons, chemical agents, explosives, and hazardous materials, to detect the presence of toxic or semitoxic gases, and illegal drugs, to uncover hidden objects (e.g. under the clothing) and contraband such as fine art hidden under layers of décor painting.

Other examples of potential application of a combined X-ray and T-ray source are in the fields of medicine and chemistry. Most of these fused applications need compact high-brightness, pulse sources that combine the production of both X-rays and T-rays. Both kinds of radiations should have high peak intensity and brightness, and exhibit low average dose (for X-rays) and heat load (for T-rays).

A compact source for generation of both X-ray and T-ray ultra-short pulses in the same device is also needed in emerging ultrafast technology which has many applications outside its traditional enclaves of time-domain spectroscopy and imaging.

SUMMARY OF THE INVENTION

The present invention is a novel integration of several separate technologies developed originally for high energy particle physics, terahertz and X-ray spectroscopy communities to provide low cost, fast X-ray and T-ray sources not presently available from commercial or laboratory organizations. The compact X-T-ray, short pulse source is based on an RF photoinjector operated in a special mode, with output devices/extractors that provide intense T-ray and X-ray radiations from the same electron beam. The key feature of this invention is that the same electron beam generated in the same pulse accelerator is used consecutively to produce and extract terahertz radiation in one short extractor, and to generate X-rays or gamma rays in another short extractor (or target). Or, in another embodiment, different pulses of the beam from the same pulse accelerator can be used for T-ray generation or X-ray generation in a switched, commutative (time division) mode.

RF photoinjector generates electrons on the photocathode illuminated by short (sub-ps range) pulses produced with a commercially available laser (e.g., mode locked NdYaG or fiber optical laser). Intense microbunches of electrons are emitted from the cathode via photoemission and then accelerated. While being accelerated the electrons are focused down to sub-mm transverse dimensions to enable transportation of most of the electrons through a capillary tube having an internal dielectric layer or coating. The beam induces intense terahertz waves propagating inside the capillary tube as a resonant Cherenkov radiation. The terahertz waves are outcoupled from the tube with special outcoupling system. This system can be of open or closed type. It separates the electron beam and terahertz beam, allowing the electron beam to continue to propagate downstream. The terahertz beam is coupled out from the accelerator vacuum volume via a dielectric window. It can be transported further for subsequent use by means of lens or mirrors, open waveguide or wire guide; or be consumed on a sample after being focused with lens. The electron beam can also be transported for subsequent application(s) by known means such as magnetic lens (e.g. quadrupoles, triplets, solenoids), bending dipoles, correctors (sextupoles, octupoles), collimators, undulators, foils, etc. The electron beam can also be transported and focused onto a high-Z target to produce an intense, short-pulse, hard X-ray or soft gamma-ray radiation. The brightness of the RF photoinjector, which is high due to mechanism of photo emission and fast, well-confined accelerations preserving the low emittance of the beam emitted from the cathode. A high-Z foil or set of such foils can be used to produce ultra-short pulses of X-rays with high conversion efficiency. The Bremstrahlung radiation can be handled with known means of X-ray optics: Bragg filters, X-ray lens arrays, collimators, Bragg monochromators etc. One of the novel applications of such ultra short X-ray pulses is time-domain X-ray spectroscopy and imaging. In one of the embodiments of the invention the terahertz extractor system is a capillary tube that is made demountable. The terahertz extractor can be a large diameter tube that can be temporarily removed to allow the electron beam to produce solely X-rays at maximum brightness. In another embodiment the capillary tube is sectioned to product mm-sub-mm radiation at different frequencies or at wider bandwidth, useful for T-ray time-resolved spectroscopy or imaging.

Thus both terahertz and X-ray radiators exploit the same beam and take advantage of the high beam quality (low emittance and high peak current) available in modern RF photoinjectors. One of the advantages of the invention is that the low-energy (i.e. a few MeVs) apparatus does not produce neutrons that require heavy shielding and can be damaging or harmful for objects to be irradiated (such as hidden compartments or stowaways). The X-ray dosage from the source is much less than in conventional linac-based inspection facilities because the average current in RF photoinjector is by more than 2-3 orders lower than that in conventional linacs. The apparatus will produce sufficient amounts of pulse radiation for effective security screening of cargo containers. The high peak X-ray and soft gamma-ray fluxes exceed those from other X-ray sources that use microsecond to hundreds of nanoseconds long electron beam pulses of the same energy but much lower peak intensity. Modern X-ray detectors capable of reliably detecting short bursts of X-ray radiation are prevalent in high energy physics and applied protein crystallography at X-ray burst durations down to sub-picoseconds. Semiconductor CdZnTe detectors are routinely applied for ns resolution; a streak camera allows detecting and resolution of X-ray bursts as short as hundreds or even tens of femtoseconds (Appl. Phys. Letters 82 3553 (2003)). Such a fine resolution will allow application of time domain imaging technique that exploits time delays to identify object location.

Yet another benefit of this invention is its inherent time synchronization required by many research (such as pump-probe) and imaging applications. The ps to sub-ps laser beam can be split off to illuminate the photocathode on one path, and to trigger other synchronized devices on another path, by means of conventional laser beam splitting and optical transport. Finally the apparatus provides high peak power of THz radiation unavailable in other non-FEL sources and most of FEL sources. Such sources are demanded by both homeland security and military agencies for remote detection of hidden objects such as weapons and improvised explosive devices. This device will enable terahertz imaging of much larger objects than available today. T-rays can be used to screen people and baggage. It can also be used to screen air cargo containers via a special dielectric window. High peak power of the terahertz source (exceeding 10-100 kW) allows much deeper penetration in most non-metal materials including plastics, relatively dry agricultural products, fabrics, carpets, wood, non-polar liquids (such as oil), stone, concrete, brake pads, sand, cement, etc. Robust bolometric or pyroelectric detectors can be used as terahertz sensors due to the high power of the terahertz illumination. Time-resolved detection of short pulse (ps-range) THz radiation is an inexpensive and well developed technique that has already been implemented in time-domain terahertz spectroscopy. It uses, for instance, photoconductive antennas or electro-optical upconversion with, e.g., ZnTe plates and CCD camera. These ultra-short pulse detectors require low-power laser for lighting up (pumping) the detector. The laser beam can be split off from the photoinjector driver, thus providing the proper timing. Higher peak intensity in ultra-short pulses (shorter than in U.S. Pat. No. 7,379,530) may enable faster inspection of larger objects with combined X-rays and T-rays.

The present invention thus provides an alternative, fused technology for non-intrusive inspection and enhanced screening cargo, vehicles and personnel for homeland security. The fused source of the present invention is compact, and provides an intense, multi-frequency radiation (X-rays and T-rays) operating with a low power input source.

DESCRIPTION OF THE DRAWINGS

For a better understanding of the present invention as well as other objects and further features thereof, reference is made to the following description which is to be read in conjunction with the accompanying drawing therein.

DESCRIPTION OF THE INVENTION

Figure 1:
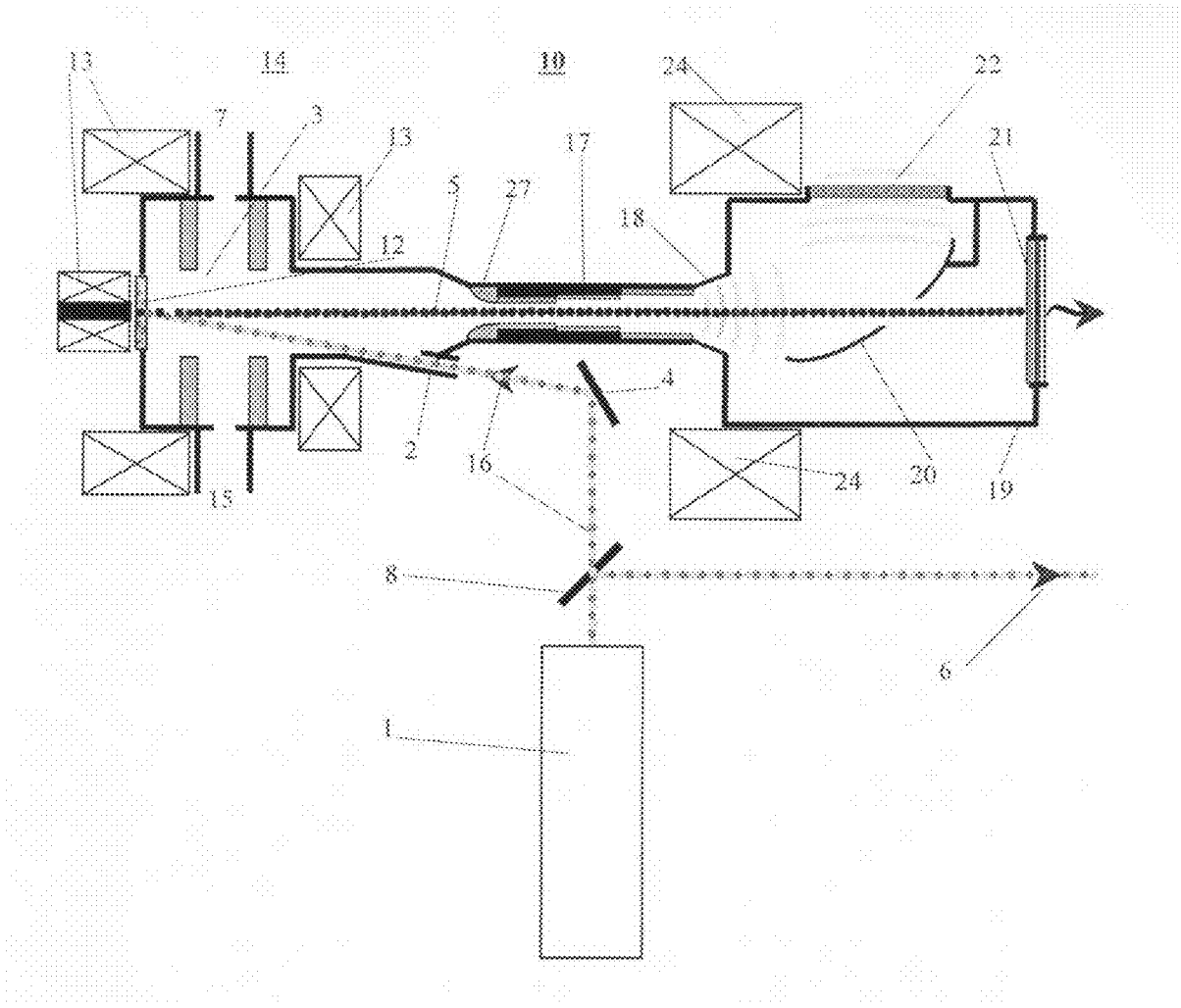
FIG. 1 shows major components of the X-T-ray source with simultaneous production of both terahertz and X-rays using the same electron beam.

A schematic diagram showing the components of the T-X ray source system 10 of the present invention is illustrated in FIG. 1. A pulse laser 1 generates a single sub-ps pulse laser beam, or a multi-ps train of short (ps-sub-ps) pulses of laser radiation 6. A portion of the laser beam 15 is separated from the main beam 16 using beam splitter 8 for use in external applications such as synchronization and detector pumping. The laser beam 16 is transported with conventional laser optics 4 into vacuum cavity 3 of the accelerator portion of system 10 through laser window 2. A mode-locked, femtosecond, e.g., Ti:Sa or NdYaG glass laser can be used with corresponding laser optical elements (mirrors, lens, harmonic converters, and optional pulse stacker). The laser beam 16 is directed onto photocathode 12 located at a cutout of the end wall 50 of the cavity 3. The photocathode material, laser frequency, and laser intensity are chosen to allow photoemission in a photoinjector. For example, for a copper photocathode, the laser wavelength is 266 nm at 100-300 μJ energy in a 50 fs pulse. Photocathode 12 is immersed in an accelerating electric field of the RF cavity 3. The resultant electron beam 5 produced by laser beam 2 is confined and accelerated in the RF cavity 3, which is powered with RF power fed through port 7 and pumped through port 15. Electron beam 5 is confined by the magnetic field produced by focusing system magnets 13. The magnets 13 also preserve the beam quality (i.e. low emittance) and focus the beam to allow its transport through a narrow collimator 27 and into channel 17. Thus the electron beam 5 is generated, accelerated, and focused to sub-mm radius with the photoinjector subsystem 14.

Figure 2:
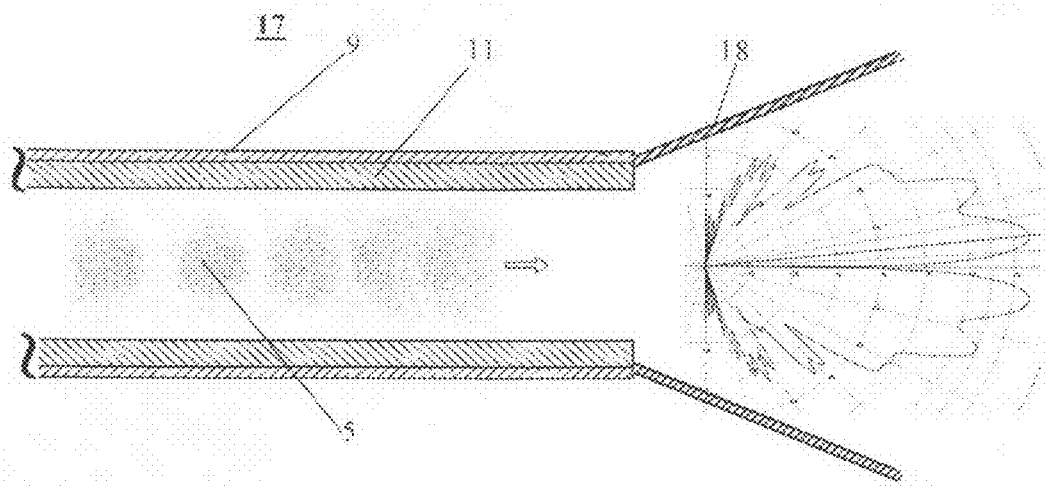
FIG. 2 presents the profile of a simulated electron beam propagating in a dielectric loaded tube and a far-field diagram of the radiation plotted in polar coordinate frame.

The collimator protects the channel walls from energetic electrons that are present in the beam halo or, in case of beam misalignment, jitter, displaced focus or insufficient focusing. As it is shown in FIG. 2, channel 17 is a capillary tube having internal dielectric layer 11 (coating) and external metal boundary 9 to form a slow-wave system operating at mm-sub-mm wavelengths. Typical dimensions are tens of microns for dielectric thickness, tube length from a few millimeters to a few centimenters, and aperture ID from a fraction of millimeter to about one millimeter. The internal layer is a low loss dielectric material with low outgassing such as quartz, diamond, sapphire, ceramics, etc. The relativistic electron beam temporal structure reproduces that of the laser beam due to low-inertial (in ps scale) response of a typical metal photocathode and uniform acceleration at pulse durations (~a few picoseconds) small compared to the radio frequency period (of the order of nanosecond). High current density of the relativistic electron beam overfocused with the electromagnets 13 induces high-amplitude wakefields as a coherent, resonant, single-mode Vavilov-Cherenkov radiation in the dielectric tube 17. For a single sub-ps laser pulse (and similar length of the electron bunch) there is a resonance resulting from the synchronism between the electron bunch velocity and phase velocity of the eigen mode wave of the tube. For a train of laser micropulses (that generate the electron microbunches) an additional synchronism takes place when the interval between microbunches is equal to (or is an integer of) a radiation wavelength in the capillary tube. These two synchronism mechanisms provide radiation build-up in the tube both in time and space domains, provided the interval between microbunches is less than the field drain time for any of the tube section. Megawatts of up to mm-sub-mm wavelength peak power of coherent radiation may be produced with a conventional photoinjector driven by a laser. The laser beam can be modulated with proper interval and number of sub pulses using conventional photomixing (wave beating) or standard multiplexing (pulse stacking) techniques.

Figure 3:
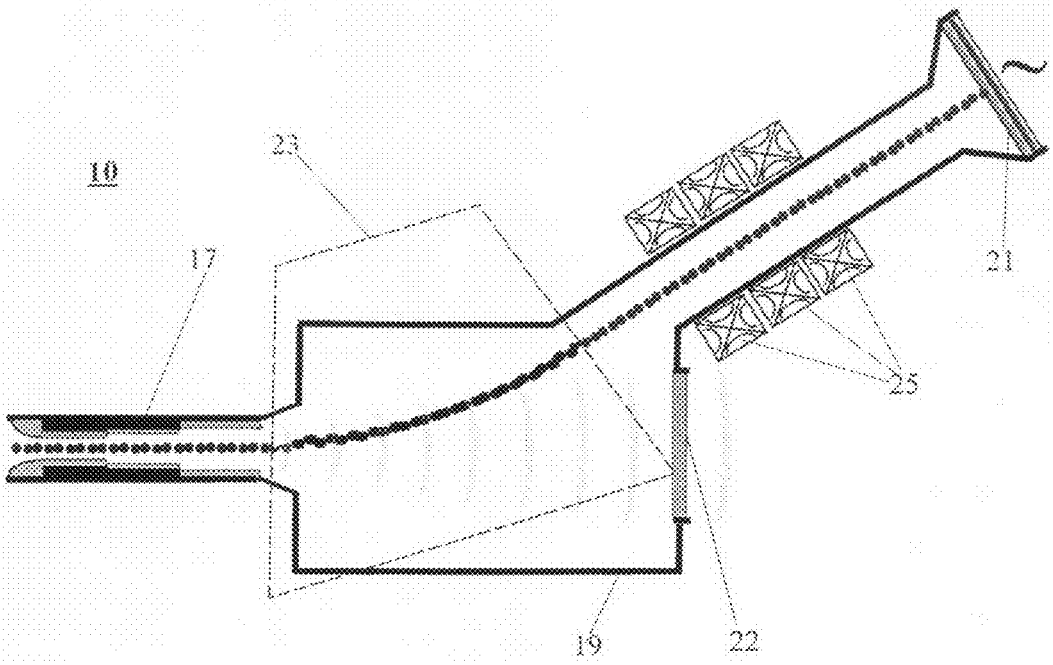
FIG. 3 shows a terahertz radiator driven with a straight electron beam and an X-ray radiator driven with a bent electron beam.
Figure 4:
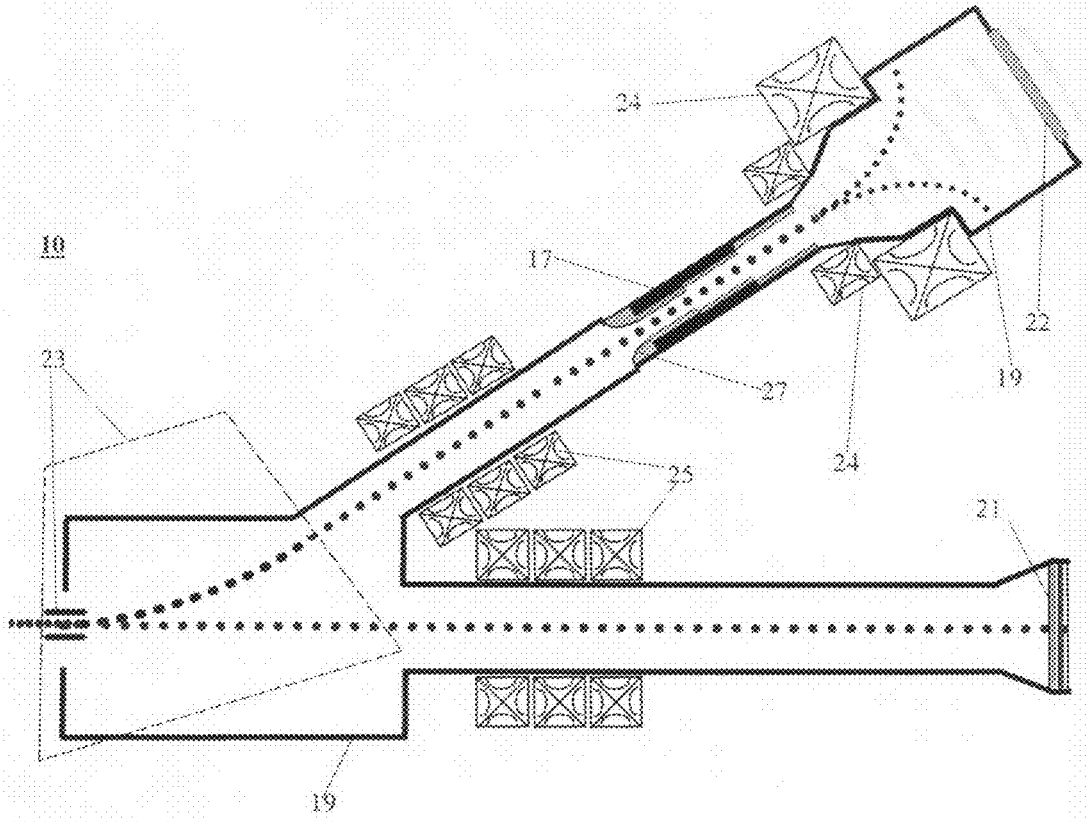
FIG. 4 shows a terahertz radiator driven by a bent electron beam and an X-ray radiator driven with a straight electron beam.

In the simplest setup the geometry of the capillary tube is longitudinally uniform as shown in FIG. 2 and similar to the one disclosed in co-pending application Ser. No. 11/999,754 filed Dec. 7, 2007. To widen the radiation bandwidth and versatility in total energy/power, it can be made shorter, or tapered, or sub sectioned. As an example, the sections shown in FIGS. 1, 3, 4 provide three "colors" or terahertz radiation. The resonant radiation emitted in the smaller section tube propagates downstream to the next larger section tube with low reflections, provided the step transition is small compared to the radius. The insertion loss related to the intersection transition can be eliminated by smoothing the transition (e.g. with tapering). The radiation emitted in the first section (at a higher frequency) is superimposed with the radiation emitted in the next section (at a lower frequency). Because of the difference in the frequencies the radiations emitted in different sections do not interfere. These radiations also do not affect the beam velocity and its overall dynamics at relativistic energies of the electron beam. In the final tube section there is a mixture of waves at three frequencies corresponding to three different sections of the tube. Since the radiation pulse is short (tens of picoseconds) and frequency is high (as least fraction of THz) the field amplitudes induced by the beam in the tube (tens of MV/m) are much below the breakdown threshold for typical dielectrics at the given (high) frequencies and (short) pulse durations. The capillary tube is attached to antenna 18 that provides efficient outcoupling of the terahertz radiation from the tube as shown in FIG. 2. Such an antenna has usually a wide bandwidth sufficient to accommodate the multi-frequency radiation induced in the sectioned tube. The overall bandwidth can also be determined or even dominated by the pulse length if the tube or its subsections are on the order of a few wavelengths. The channel can be made axially symmetric, elliptical, rectangular, square, sideways opened etc. to provide sufficient shunt impedance and efficiency, and to ease manufacturability and functionability. The terahertz beam radiated from the antenna 18 has a donut-shaped radiation pattern seen in FIG. 2 which corresponds to the lowest Gaussian mode. Antenna 18 is attached directly to the tube and provides effective coupling of the monopole $TM_{01}$ mode launched by the electron beam in the capillary tube with the Gaussian monopole mode in free space. According to simulations the return losses can be made low (less than −14 dB) with good directivity (about 15-17 dBi). The antenna directivity also provides a certain difference between the divergence of the terahertz beam and the smaller divergence of the electron beam. This difference in combination with the absence of on-axis terahertz radiation provides an effective separation of the terahertz and the electron beam with mirror 20 (see FIG. 1) having a hole 52 for electron beam passage. The mirror is tilted to redirect the terahertz beam away from the electron beam and to pass it through window 22 which is transparent to terahertz radiation while maintaining vacuum inside volume 19. The in-vacuum mirror 20 has a surface that provides high reflectivity (e.g. a gold plated metal) and can be flat or concave, either parabolic or elliptic. A concave, hollowed mirror can provide simultaneous focusing of the terahertz beam to decrease the terahertz beam transport loss, reducing the dimension of window 22 and also facilitating further handling and usage (e.g., focusing on a sample) of the terahertz beam. The window 22 can be made from such materials as alumina, quartz, Teflon, diamond, sapphire, or ceramics to provide high transparency for terahertz waves and vacuum compatibility. A window functioning as a lens can also provide additional focusing (or defocusing) of the terahertz beam to adapt it for external transportation and/or further usage.

Thus the terahertz beam is separated from the electron beam and out-coupled from the vacuum volume 19 whereas the electron beam having a waist inside the tube 17 propagates forward and diverges. The focusing element 24 refocuses the electron beam to provide a limited beam spot on the converter 21. The focusing element 24 also improves the electron beam transportation through the hole 52 in mirror 20 with less electron beam losses. The size of hole 52 may also be reduced to decrease the terahertz beam losses.

A high-Z target 21, e.g. tungsten, tantalum, or lead, converts the electron beam into hard X-ray Bremstrahlung radiation. The small cross-section of the beam focused with lens 24 provides a bright X-ray beam for practical applications (e.g. cargo inspection). The X-ray converter made of a high-Z foil also preserves the ps-sub-ps bunch length due to its short transit time. Another advantage of the photoelectron induced Bremstrahlung radiation is the compactness and the relatively high conversion efficiency compared to other techniques such as backward Compton scattering, wiggler or undulator radiations. The last two require much higher electron beam energies of GeV level. The output electron beam 54 is coupled to X-ray optics instrumentation including polycapillary X-ray collimators and lenses (not shown). High voltage X-ray tubes and linac-based X-ray sources employ converter cooling because of substantial average power of the electron beam. Since the average beam power in an RF photoinjector is considerably less than that in conventional X-ray facilities based on linacs with thermionic cathode (estimated to be about two orders), the cooling of the target is eased if required at all.

Another advantage of the ultra-short pulse mode of operation is reduced background of X-ray and gamma radiation from the linac due to low average current and energy of the photoelectron beam, thus enabling relatively light, local radiant shielding of the order of hundreds of kilograms instead of tens of tons for typical linac facility for cargo inspection. The reduced radiation background also simplifies transport and practical usage of terahertz radiation.

Different usage and applications of the fused source may require different configurations of terahertz and X-ray instrumentation such as transportation optics, beam lines, targets/samples and sensors/detectors. The above teachings can be easily applied to meet different requirements on the X- and terahertz beams out coupled from system 10.

The second embodiment illustrated in FIG. 3 provides direct, on-axis outcoupling of the terahertz beam with minimum loss distortion. Similar to the first embodiment shown in FIG. 1, the X-ray converter utilizes the same electrons that produced the terahertz radiation. Unlike the first embodiment, the electrons are deflected with bending magnet 23 to separate the terahertz and electron beams without a mirror. After passing through the radiator 17 and the bending dipole magnet 23 the electron beam is transported to the converter with a special focusing system 25. The focusing system 25 may consist of, for example, a triplet of quadrupoles to provide flexibility in shaping and focusing the electron beam and the X-rays it generates. This configuration is convenient for direct, on-axis terahertz beam manipulation and off-axis, remote X-ray instrumentation. The magnet 23 can also provide focusing in one or both transverse directions.

A third embodiment is illustrated in FIG. 4 and comprises a switchable magnet or deflector 23 that distributes different pulses of the electron beam over different beamlines: one for the terahertz extractor and one for the X-ray converter. In this embodiment the terahertz radiation and X-rays are generated from different electrons. Since different radiators use different pulses they do not interfere with each other, allowing optimization of the performance of these two radiators independently. The beam size and shape are controlled individually for each beamline (in extractor 17 and on the target 21) with quadrupole magnets 25 (e.g., triplets) to enable a small spot on the target or inside the channel. Non-circular beams can also be generated if needed. The magnetic system provides beam divergence and deposition on the wall of the beam collector 19. The system 24 can comprise, for example, a doublet of quadrupoles or a single dipole (bending) magnet to separate the electron and terahertz beams, similar to that in FIG. 3.

Figure 5:
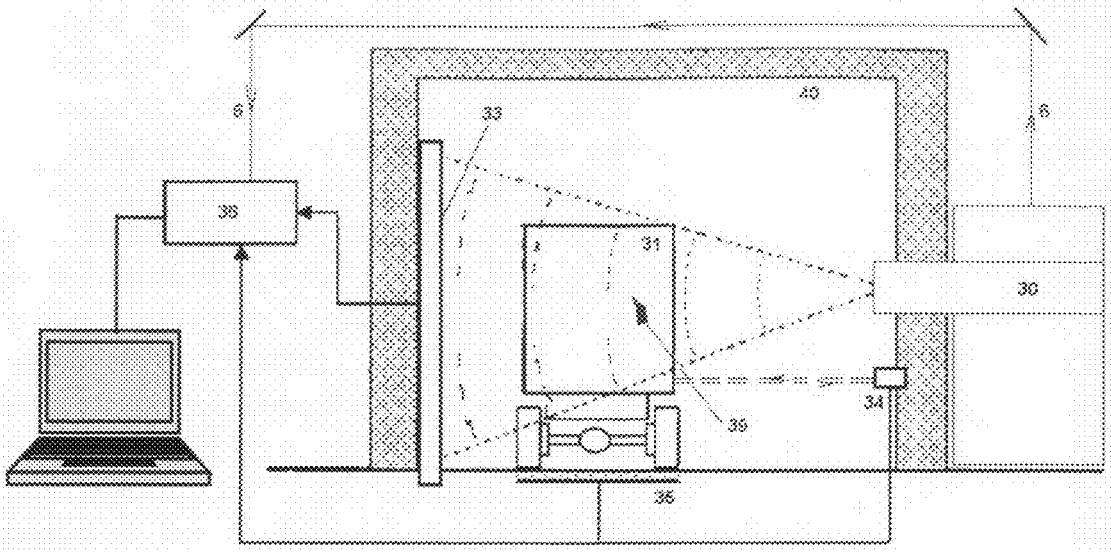
FIG. 5 illustrates an ultra-short pulse gamma-ray source for illuminating a container within a drive-through portal in which two-dimensional screening is performed on the cargo inside a container.

In a fourth embodiment, the source 30 is utilized as a short-pulse X-ray source for portal inspection system based on a photoinjector as described above, in the absence of the THz radiator-extractor and associated hardware. Detection of heavy material such as lead, uranium, plutonium and other nuclear substances is performed with the short pulse source 30 as shown in FIG. 5. Source 30 is mounted on the sidewall of portal 40. A container 31 is moved along the portal 40 with a known velocity while its horizontal position, weight, velocity and other characteristics are controlled with sensors 34 and 36. The source comprises pulse RF photoinjector 14 and thin foil high-Z target 21 as described above and shown in FIGS. 1, 3, 4 and delivers short picoseconds bursts of gamma radiation propagating towards container 31. Container 31 may contain high-Z object 39 that absorbs gamma-rays. The 2D array of detectors 33 sensitive to picoseconds X- and gamma rays form a set of electrical signals with magnitudes proportional to the permeability of the container content. The data from the detectors are processed in unit 36 with techniques of correction, enhancement and reduction of background parasite and noise signals. In processor 36 the signals are synchronized with the source 30 by means of optical signal 6 to form a high-contrast digital image for every pulse of the electrons produced in the accelerator. The pulse rate of accelerated electron pulses can be as high as tens and hundreds of Hertz, depending on pulse rate capabilities of the laser and RF power supply.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A method for generating short picoseconds pulses of both X-rays and terahertz rays (T-rays) from a tube comprising the steps of:

generating short, sub-ps laser beam pulses;

generating photoelectrons from a photocathode irradiated with said laser beam pulses along an axis;

accelerating said electrons to relativistic velocities;

focusing the accelerated electrons down to sub-millimeter transverse dimensions;

passing said electrons through a capillary tube partially loaded with dielectric material;

coupling terahertz radiation from said tube using an antenna;

redirecting the terahertz radiation away from said axis of the electron beam by means of a concave tilted mirror having a hole for electron beam passage;

coupling the terahertz beam through a window placed adjacent the electron beam;

refocusing the electron beam and directing the beam towards a high-Z target placed downstream from the incident electron beam; and generating short pulses of X-rays and gamma-rays with Bremstrahlung radiation by directing the electron beam onto said high-Z target.

2. The method of claim 1 whereby the capillary tube geometry is sectioned along the tube axis, different frequencies being generated in different sections, the frequencies decreasing from section to section along said axis.

3. A method for generating short picoseconds pulses of both X-rays and terahertzrays (T-rays) from a dielectric tube, said tube having a longitudinal axis, comprising the steps of:

generating short, sub-ps laser beam pulses;

generating photoelectrons from a photocathode irradiated with said laser beam pulses along an axis;

accelerating said electrons to relativistic velocities;

focusing the accelerated electrons down to sub-millimeter transverse dimensions;

passing said electrons through a capillary tube partially loaded with dielectric material;

outcoupling terahertz radiation from said tube using an antenna;

bending said electron beam with a permanent magnetic field;

coupling the terahertz radiation out through a window aligned with said tube axis;

refocusing said electron beam and directing the beam towards a high-Z target placed downstream from the incident electron beam; and generating short pulses of X-rays and gamma-rays with Bremstrahlung radiation by directing said electron beam onto said high-Z target.

4. A method for generating short picoseconds pulses of both X-rays and terahertzrays from a tube having an axis comprising the steps of:

generating short, sub-ps laser beam pulses;

generating photoelectrons from a photocathode irradiated with said laser beam pulses;

accelerating said electrons to relativistic velocities;

passing said electron beam through a pulse dipole magnet controlled by an external circuit;

directing a first portion of said electron beam pulses using said magnet onto a first transport channel having focusing magnets and terminated with a high-Z target for generation of X-ray and gamma-ray radiation;

directing a second portion of the electron beam pulses using said magnet onto a second transport channel and focusing said second portion of said beam down to sub-millimeter transverse dimensions;

passing said electron beam in the second channel via a capillary tube partially loaded with dielectric material;

outcoupling the terahertz radiation from the tube with an antenna;

defocusing said electron beam with a magnetic system;

deposing and collecting the defocused electron beam on the internal wall of said second channel; and coupling the terahertz radiation from the vacuum volume through a window aligned on said tube axis.

5. A method for generating short picoseconds pulses of both X-rays and terahertzrays (T-rays) comprising the steps of:

generating short, sub-ps laser beam pulses;

generating photoelectrons from a photocathode irradiated with said laser beam pulses;

accelerating said electrons to relativistic velocities;

focusing the accelerated electrons down to sub-millimeter transverse dimensions;

redirecting the terahertz radiation from the axis of the electron beam;

refocusing the electron beam and directing the beam towards a high-Z target positioned downstream from the incident electron beam; and generating short pulses of X-rays and gamma-rays with Bremstrahlung radiation by directing the electron beam onto said high-Z target.

* * * * *